US007854251B2

(12) United States Patent
Smetan

(10) Patent No.: US 7,854,251 B2
(45) Date of Patent: Dec. 21, 2010

(54) METHOD AND DEVICE FOR CASTING MOLTEN METAL

(75) Inventor: Herbert Smetan, Siersburg (DE)

(73) Assignee: Hydro Aluminium Alucast GmbH, Dilligen (DE)

( * ) Notice: Subject to any disclaimer, the term of this patent is extended or adjusted under 35 U.S.C. 154(b) by 705 days.

(21) Appl. No.: 11/574,695

(22) PCT Filed: Sep. 2, 2005

(86) PCT No.: PCT/EP2005/009469

§ 371 (c)(1),
(2), (4) Date: Nov. 15, 2007

(87) PCT Pub. No.: WO2006/027174

PCT Pub. Date: Mar. 16, 2006

(65) Prior Publication Data

US 2008/0190581 A1 Aug. 14, 2008

(30) Foreign Application Priority Data

Sep. 6, 2004 (DE) ..... 10 2004 043 444

(51) Int. Cl.
*B22D 18/04* (2006.01)
*B22D 35/04* (2006.01)

(52) U.S. Cl. ..... 164/119; 164/136; 164/306; 164/335; 164/336

(58) Field of Classification Search ..... 164/119, 164/136, 306, 335, 336
See application file for complete search history.

(56) References Cited

U.S. PATENT DOCUMENTS

| | | | | |
|---|---|---|---|---|
| 5,524,700 | A * | 6/1996 | Gosch | 164/136 |
| 6,715,535 | B2 * | 4/2004 | Kahn et al. | 164/136 |
| 6,899,159 | B2 | 5/2005 | Fischer et al. | |
| 6,978,980 | B2 * | 12/2005 | Plattner et al. | 251/176 |
| 7,134,479 | B2 * | 11/2006 | Bend | 164/136 |

FOREIGN PATENT DOCUMENTS

| | | |
|---|---|---|
| DE | 100 33 903 | 11/2001 |
| WO | 2004/039516 | 5/2004 |

* cited by examiner

*Primary Examiner*—Jessica L Ward
*Assistant Examiner*—Kevin E Yoon
(74) *Attorney, Agent, or Firm*—Proskauer Rose LLP

(57) ABSTRACT

The invention makes it possible to manufacture high-quality cast parts in a productive manner in that a casting mould with a filling opening pointing in the direction of gravity is provided during the casting of molten metal. The casting mould with the filling opening is coupled to a melt container containing the molten metal, and the molten metal is conveyed from the melt container into the casting mould counter to the direction of gravity. The casting mould is sealed directly after filling with molten metal using a locking means which is at least temporarily connected to the casting mould in a fixed manner, in that the casting mould is decoupled from the melt container directly after closure of the casting mould and in that the casting mould is rotated about a horizontal axis of rotation, wherein the casting mould remains in a sealed position with respect to the locking means.

7 Claims, 2 Drawing Sheets

METHOD AND DEVICE FOR CASTING MOLTEN METAL

FIELD OF THE INVENTION

The invention relates to a method and a device for casting molten metal, in particular light molten metals, such as aluminium-based melts.

BACKGROUND OF THE INVENTION

For the manufacture of cast parts, there is conventionally provided a casting mould having a moulding cavity forming the cast part to be manufactured. The molten metal is then cast out from a melt container into the moulding cavity. The melt container can, for example, be a casting furnace or another container which is filled with melt and in which the melt is kept at a temperature level required for casting. Once the melt in the casting mould has solidified to form the cast part to be manufactured, the casting mould and casting part are separated from each other.

The properties of a cast part are influenced markedly by the course of the solidification of the melt in the casting mould and the backfeed required to compensate for the shrinkage in volume. A particularly uniform distribution of properties is thus displayed if the mould is filled with melt in a continuous process, avoiding comparatively large streams of melt in the casting mould, and the solidification starts distributed uniformly and on the side of the casting mould opposing the feeder.

For this purpose, methods are known in which the melt is conveyed into the casting mould counter to the direction in which gravity acts. In some of these casting methods, referred to by specialists as "rising casting", the melt container is arranged below the casting mould. The melt is then pressed into the moulding cavity of the casting mould via a riser pipe by subjecting to pressure the atmosphere impinging above the melt in the melt container. This generally takes place in that a pressurised gas is introduced into the melt container chamber remaining free of melt. Alternatively, for conveying the melt, low pressure can also be applied to the moulding cavity of the casting mould or the molten metal can be conveyed into the casting mould using electromagnetic forces.

This filling of the casting mould with melt counter to the direction of gravity has the advantage that a steady and controlled casting course is achieved with minimised turbulence of the melt. The risk of casting errors in the cast part manufactured can thus be greatly reduced. However, methods of this type have the drawback that the casting moulds have in each case to dwell in the casting plant for a long period of time required for complete solidification of the cast part formed in each case therein.

A device for carrying out rising casting is known, for example, from DE 100 33 904 A1. In the case of this known device, there is arranged between the casting mould and the melt container a slide closure formed from two plates which are located one on top of the other, are displaceable relative to each other and each have a through-opening. For filling the casting mould, the through-openings are made to overlap, so melt can flow from the melt container into the casting mould through a riser pipe. As soon as the casting mould is filled, one of the slide plates is displaced relative to the other, so the through-openings are closed. The casting mould can then be dispatched and a further casting cycle started.

As soon as a plug of solidified melt has formed in the filling opening in the casting mould, the slide closure can be removed for use. In order to shorten the waiting time preceding this stage, there can be provided on the filling opening a cooling means causing targeted cooling of the melt present in the filling region.

For further improving the quality of cast products, it has been proposed to rotate the casting mould for filling with melt. For this purpose, DE 100 19 309 A1 has proposed linking the upwardly oriented opening in a melt container containing molten metal to a downward pointing filling opening in a casting mould. The casting mould is then rotated, in conjunction with the melt container firmly connected thereto, through approx. 180°. During the course of the rotation, the melt passes from the melt container into the casting mould. Once the end position of the rotation has been reached, the melt container is removed from the casting mould. The hot residual melt, now located on top, in the feeder region can then continue to remain active, under the effect of gravity, and compensate particularly effectively for the loss in volume accompanying the solidification of the melt.

The rotation of the casting mould with the melt container allows the casting mould to be filled completely with molten metal. The fact that the molten metal introduced into the casting mould is exposed to gravity uniformly during the rotation of the mould ensures that the melt passes, on rotation, into all regions of the moulding cavity of the casting mould forming the cast part to be cast. In addition, this casting method, also referred to by specialists as "rotational casting", optimises the structural constitution on account of directed solidification caused by the orientation of the casting mould accompanying the rotation, thus allowing the manufacture of high-quality cast parts of complex geometric construction.

However, in the case of the known method, the filling of the mould is not optimal if, for example, cylindrical internal geometries require particularly homogeneous solidification morphologies.

In addition to the prior art described hereinbefore, DE 196 49 014 A1 also discloses a method and a device for manufacturing cast parts made of aluminium alloys. Provision is made in this case, for increasing productivity, for the molten aluminium to be pressed upward at a comparatively low pressure into a casting mould made of a gasifiable foam via a riser pipe. After casting-out, the casting mould is rotated, together with the casting container, about an axis of rotation extending substantially horizontally in the region of advance of the cast part.

SUMMARY OF THE INVENTION

The object of the present invention was to form, at high productivity, cast parts which reliably meet even more stringent quality requirements.

This object has been achieved, firstly, by a method for casting molten metal including the following steps:

- providing a casting mould with a filling opening pointing in the direction of gravity,
- coupling the casting mould with the filling opening to a melt container containing the molten metal,
- conveying the molten metal from the melt container into the casting mould counter to the direction of gravity,
- sealing the casting mould directly after filling with molten metal using a locking means which is at least temporarily connected to the casting mould in a fixed manner,
- decoupling the casting mould from the melt container directly after closure of the casting mould,
- rotating the casting mould about a horizontal axis of rotation, wherein the casting mould remains in a sealed position with respect to the locking means which is firmly connected thereto during rotation.

Secondly, the above-mentioned object has also been achieved by a device for casting molten metal provided with a casting mould having a filling opening, with a means for coupling the casting mould to a melt container which, in this operating position, is arranged below the casting mould and contains the molten metal, with a means for conveying the molten metal from the melt container into the casting mould through the filling opening counter to the direction of gravity, with a means for decoupling the casting mould from the melt container, with a means for rotating the casting mould, when decoupled from the melt container, about a horizontal axis associated with the casting mould, with a control means which issues a signal for rotating the casting mould about the axis of rotation thereof when the casting mould is filled with melt, and with a locking means, which is connected to the casting mould in a fixed manner at least during rotation about the horizontal axis thereof, for closing the filling opening in the casting mould.

The invention combines rising casting with rotational casting. In order to achieve short cycle times in this regard, the invention provides a closure which is connected to the casting mould and remains secured to the casting mould during rotation, sealing it. In this way, it is no longer necessary to wait for a sufficient amount of solidified molten material to form in the filling opening in the casting mould before commencing the rotational movement; instead, the rotational movement can start as soon as the filling of the casting mould has been completed. This in itself provides much shorter cycle times than are possible in conventional rising casting.

If, immediately after the filling with melt, the casting mould is sealed by a locking means firmly connected to the casting mould at least during the rotating process, the casting mould can be decoupled from the melt container immediately after sealing, while the molten metal is still in a liquid state.

If an upper position of the casting mould is then achieved, the locking means can, according to an advantageous embodiment of the invention, be separated from the melt container. In this position, in which the effect of gravity prevents melt from running out of the casting mould, there is no longer any risk—unlike in the filling position and during the rotation process itself—of melt issuing. The locking means separated from the casting mould can then be used again for sealing casting moulds to be filled subsequently.

If the casting mould can be rotated immediately after filling, in that it remains, in accordance with the invention, sealed with a locking means even during the rotating process, the melt container is ready, immediately after the casting-off of the molten metal into the casting mould, for the next casting process and, if necessary, for renewed filling with molten metal. This also leads to the productivity, the cost-effectiveness and the availability of a device according to the invention being increased over the prior art.

Furthermore, the arrangement according to the invention of a locking means firmly connected to the casting mould at least for the period of the rotation easily allows the rotation of the casting mould to be carried out without a melt container linked to the casting mould.

In the procedure according to the invention, the casting-out of cast parts can therefore not only be carried out within the short cycle times but also takes place in a mode of operation which is easily practicable in terms of the equipment required. The method according to the invention and the device according to the invention can, in this case, be implemented in an operably reliable manner. That is to say, it has surprisingly been found that the locking means can be connected to the casting mould sufficiently firmly to keep the casting mould reliably sealed during rotation, despite the resultant loads, and reliably to prevent the molten metal, which is still in a liquid state, from issuing from the mould. This was all the more surprising in view of the fact that use was made of locking means of this type which are detached from the casting mould after rotation in order to be reused.

The invention accordingly provides high-quality cast parts by complete filling of the mould, with optimum solidification of the molten metal, productivity being at the same time markedly increased over the prior art.

The melt container can, for example, be a low-pressure casting furnace known per se.

The molten metal can be conveyed from the melt container into the casting mould by the application of pressure to the surface of the melt. For this purpose, a device according to the invention can comprise a means for applying pressure to the surface of the melt in the melt container. The means for applying pressure can, in particular, be a compressed gas supply means which is connected to the interior of the melt container via a valve and via which there can be guided into the interior pressurised gas applying pressure to the surface of the melt contained in the interior of the melt container. The gas can be air. However, if the risk of oxidation in the melt container is to be reduced, use can also be made of a gas which is inert relative to the molten metal, for example nitrogen or a noble gas.

A particularly robust embodiment of a device according to the invention is obtained if the locking means is in the form of a slide closure. A slide closure of this type is conventionally characterised in that a first element of the closure can be displaced in such a way that in a first position of the element, an opening to be locked is opened and in a second position of the element, the opening is closed. A slide closure of this type is easy to manufacture and takes up little overall space. The slide closure based on the model of the prior art can, in particular, have at least two plates each with a respective through-opening, wherein for closing the casting mould at least one of the plates is displaced from an opened position, in which the through-openings overlap, into a closed position, in which the through-openings are completely offset relative to each other. An embodiment of this type of the slide closure is, on the one hand, robust and simple to apply in terms of production. On the other hand, this embodiment particularly reliably ensures that no molten metal issues from the casting mould on rotation of the casting mould.

Should the invention be used in large-scale production, the casting mould can be a permanent casting mould. However, in order to exploit the advantages of non-permanent moulds, such as for example the high flexibility, it is also possible to make the casting mould from moulding material parts such as, for example, moulding sand parts. A casting mould of this type, also referred to as a core package, is destroyed after the casting process and the solidification of the molten metal to form the cast part, so the finished cast part is then obtained. However, it is also conceivable for the casting mould to have both permanently cast parts and moulding material cores if, for example, complex internal shapes of the cast part are to be produced.

BRIEF DESCRIPTION OF THE FIGURES

Further embodiments of the invention are recited in the dependent claims and will be described hereinafter in greater detail with reference to drawings showing an exemplary embodiment of the invention. In the drawings:

DETAILED DESCRIPTION

Figure 1:
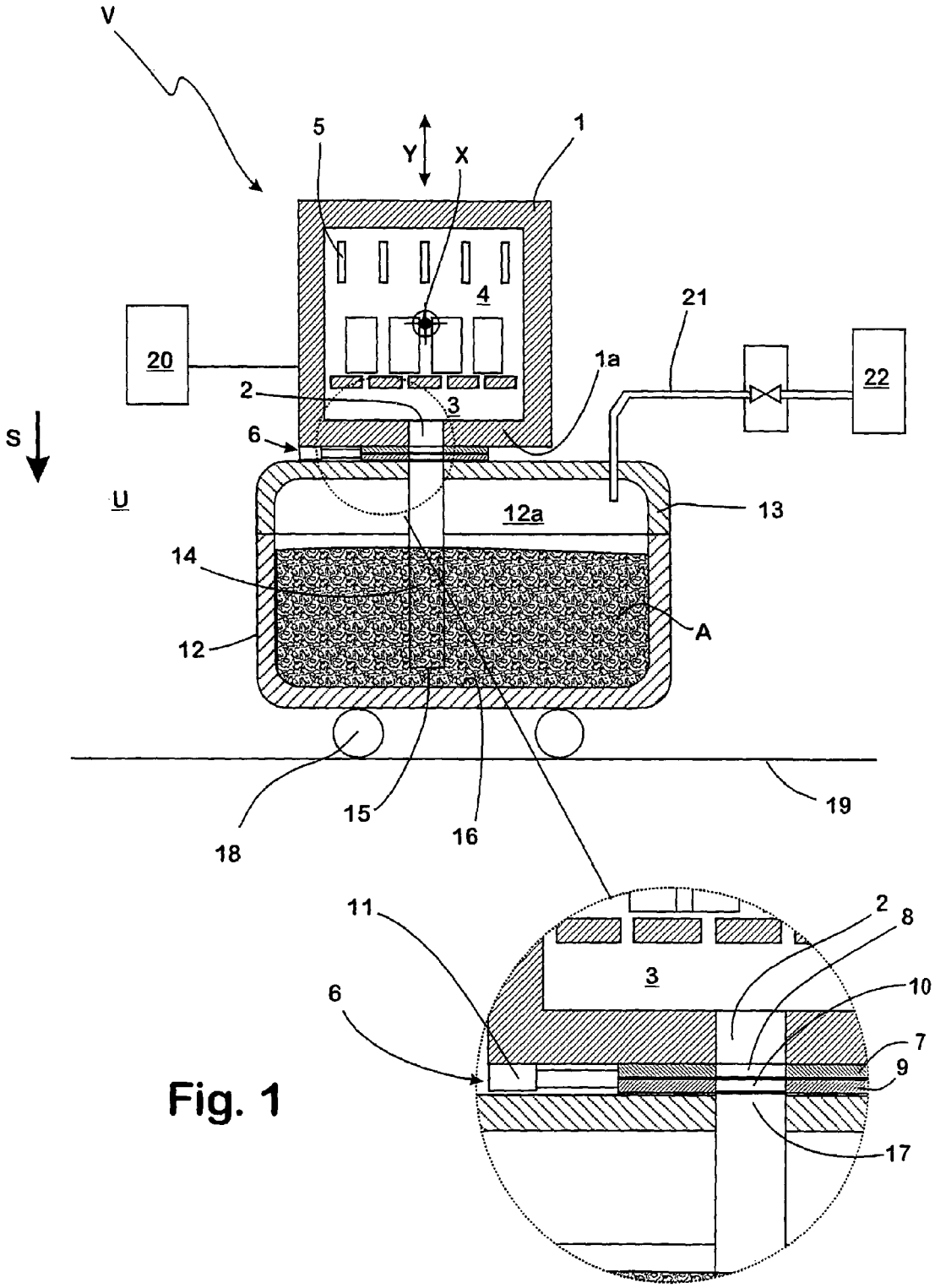
FIG. 1 to 5 are each schematic, partially exploded side views of a device for casting light molten metal in four different operating positions.

The device V for casting an aluminium-based melt A comprises a casting mould 1, in the one wall 1*a* of which a filling opening 2 is formed. The filling opening 2 opens into a feeder portion 3 which is formed in the casting mould 1 and feeds the moulding cavity 4 through which the cast part to be manufactured is formed. Cooling irons 5 are inserted in the moulding cavity 4. When the melt A is introduced into the moulding cavity 4, the cooling irons 5 cause a targeted solidification course to form a specific structural constitution in the regions of the cast part that are associated with the cooling irons 5.

A locking means 6 in the form of a slide closure is detachably fastened to that wall 1*a* of the casting mould 1 in which the filling opening 2 is formed. The locking means 6 has a first slide plate 7, which is directly associated with the wall la and in which a through-opening 8 is formed at a central location, and a second slide plate 9, which rests on the first slide plate 7 and in which a through-opening 10 is also formed. The diameter and shape of the through-openings 8, 10 are adapted to the diameter and the shape of the filling opening 2. The slide plates 7, 9 can be displaced relative to each other using an adjustment means 11 in order, in a through-position, to cause their through-openings 8, 10 to overlap each other and the filling opening 2 and to bring them into a closure position in which the closed portion, located outside the through-opening 8, of the slide plate 7 closes the filling opening 2 and in which even a closed portion, located outside the through-opening 10, of the second slide plate 9 is arranged below the filling opening 2 and supports the portion of the first slide plate 7 that directly closes the filling opening 2.

The casting mould 1 is mounted, on pivot bearings (not shown), so as to be able to rotate about a horizontally oriented axis of rotation X. The casting mould 1 can be rotated about the axis of rotation X using a means (also not shown). The casting mould 1 can also be raised in the vertical direction Y using an adjustment means (also not shown).

The device 1 further comprises a melt container 12 in which the molten aluminium A to be cast is stored. The melt container 12 has a lid 13 with which the melt container 12 can be sealed tightly from the environment U. Guided through the lid 13 is a perpendicularly oriented riser pipe 14, the inlet opening 15 in which is arranged just above the base 16 of the melt container 12. In the operating position, on the other hand, the outlet opening 17 in the riser pipe 14 is positioned just above the lid 13. The melt container 12 is mounted on rolls 18 guided on rails 19.

The orientation and rotation of the casting mould 1 and the working positions of the locking means 6 are controlled by a control means 20.

For conveying the melt A out of the melt container 12, the interior enclosed by the melt container 12 when the lid 13 is attached can be acted on by a compressed gas, for example air or nitrogen. For this purpose, a supply line 21 is fed through the lid 13 into the interior 12*a* of the melt container 12. The supply line 21 is connected to a compressed gas supply means 22 which provides a volume of gas with sufficient pressure required for expelling the requisite amount of melt in each case.

In the starting position for filling, the empty casting mould I is oriented in such a way that its filling opening 2 is directed downward in the direction S of gravity. The locking means 6 is opened by causing the through-openings 8, 10 in its slide plates 7, 9 to overlap each other and the filling opening 2.

The outer slide plate 9 of the casting mould rests, in this case, on the lid 13 of the melt container 12 which is positioned below the casting mould 1 and tightly sealed by the lid, the outlet opening 17 in the riser pipe 14 being oriented in alignment with the filling opening 2 in the casting mould 1. The moulding cavity 4 of the casting mould 1 is thus connected to the interior 12*a* of the melt container 12 (FIG. 1).

Figure 2:
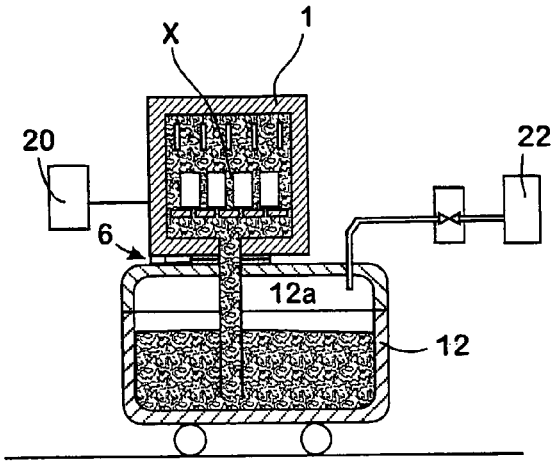

The compressed gas supply means 22 then presses compressed gas into the interior 12*a* of the melt container 12, causing the melt A to rise through the riser pipe 14 into the casting mould 1 and to fill the moulding cavity 4 of the casting mould 1 in a steady stream. The atmosphere contained in the moulding cavity 4 escapes, in this case, via ventilation openings (not shown). The application of pressure causes the melt A contained in the moulding cavity 4 of the casting mould 1 to be introduced uniformly, substantially avoiding turbulence, into all cavities formed in the moulding cavity 4, thus allowing even complex moulded parts, such as engine units for internal-combustion engines or the like, to be produced reliably and with optimum working results (FIG. 2).

Figure 3:
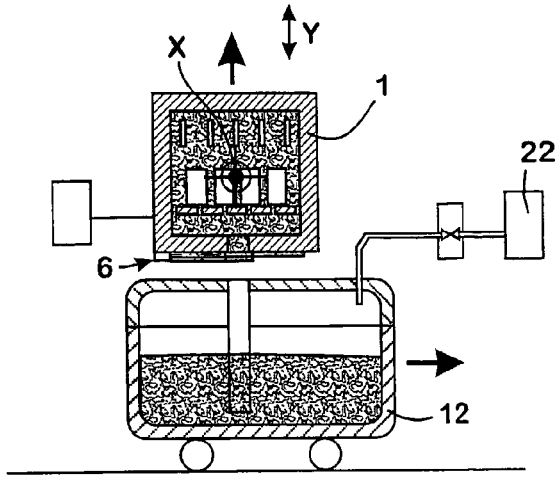

As soon as the filling process is completed, the control means 20 issues a signal for closing the locking means 6. For this purpose, the slide plates 7, 9 of the locking means 6 are displaced relative to each other, while preserving the pressure in the melt container 12, until their through-openings 8, 10 are closed by the closed portion of the other slide plate 9, 7 in each case. As soon as this process is completed, the casting mould 1 is raised in the vertical direction Y and thus separated from the melt container 12. The melt container 12 can then be moved on the rails 19 to a further filling station (not shown in the present case) where a further empty casting mould is already waiting to be filled (FIG. 3).

Figure 4:
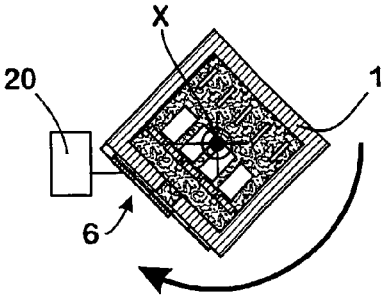

As soon as the casting mould 1 has been separated from the melt container 12, the control means 20 issues a signal for rotating the casting mould 1 (FIG. 4).

Figure 5:
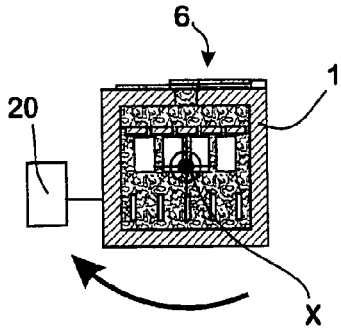

The rotating means (not shown) subsequently rotates the casting mould 1 through 180° about the axis of rotation X until its filling opening 2, which is still closed by the locking means 6, points upward. Once this upper position, oriented counter to the direction of gravity, has been reached, the locking means 6 can be detached from the casting mould 1 and supplied for use on a casting mould (not shown in the present case) subsequently to be filled with molten metal A (FIG. 5).

The invention thus ensures that the cast parts obtained meet even the most stringent requirements and no significant waste occurs during the manufacture of the cast parts. At the same time, cast parts are manufactured, in accordance with the invention, in a simplified manner and with increased productivity.

REFERENCE NUMERALS

A Molten aluminium
U Environment of the device V
S Direction of gravity
V Device for casting an aluminium-based melt A
X Axis of rotation of the casting mould 1
Y Vertically oriented axis of adjustment of the casting mould 1
1 Casting mould
1*a* Wall of the casting mould 1
2 Filling opening
3 Feeder portion
4 Moulding cavity
5 Cooling irons
6 Locking means
7 Slide plate
8 Through-opening in the slide plate 7

9 Slide plate
10 Through-opening
11 Adjustment means
12 Melt container
12*a* Interior of the melt container 12
13 Lid of the melt container 12
14 Riser pipe
15 Inlet opening in the riser pipe 14
16 Base of the melt container
17 Outlet opening in the riser pipe 14
18 Rolls
19 Rails
20 Control means
21 Supply line
22 Compressed gas supply means

The invention claimed is:

1. Method for casting a molten metal including the following steps:

providing a casting mould with a filling opening pointing in the direction of gravity, coupling the casting mould with the filling opening to a melt container containing the molten metal, conveying the molten metal from the melt container into the casting mould counter to the direction of gravity, sealing the casting mould directly after filling with molten metal using a locking means which is at least temporarily connected to the casting mould in a fixed manner, decoupling the casting mould from the melt container directly after closure of the casting mould, rotating the casting mould about a horizontal axis of rotation, wherein the casting mould remains in a sealed position with respect to the locking means which is firmly connected thereto during rotation, the locking means being separated from the casting mould after rotation of the casting mould.

2. Method according to claim 1, wherein the locking means is detached from the casting mould once it has reached an upper position.

3. Method according to claim 1, wherein the molten metal is conveyed from the melt container into the casting mould via a riser pipe.

4. Method according to claim 1, wherein the molten metal is conveyed from the melt container into the casting mould by the application of pressure to the surface of the melt.

5. Method according to claim 1, wherein the locking means is in the form of a slide closure.

6. Method according to claim 5, wherein locking means has at least two plates with respective through-openings, wherein for closing the casting mould at least one of the at least two plates is displaced from an opened position, in which the through-openings overlap, into a closed position, in which the through-openings are completely offset relative to each other.

7. Method according to claim 1, wherein the casting mould is rotated through about 180°.

* * * * *